US007282988B2

(12) United States Patent
Mejri

(10) Patent No.: US 7,282,988 B2
(45) Date of Patent: Oct. 16, 2007

(54) BANDGAP REFERENCE CIRCUIT

(75) Inventor: Jaafar Mejri, Ottobrunn (DE)

(73) Assignee: Infineon Technologies AG, Munich (DE)

( * ) Notice: Subject to any disclaimer, the term of this patent is extended or adjusted under 35 U.S.C. 154(b) by 132 days.

(21) Appl. No.: 11/037,389

(22) Filed: Jan. 14, 2005

(65) Prior Publication Data

US 2005/0225378 A1 Oct. 13, 2005

(30) Foreign Application Priority Data

Jan. 16, 2004 (DE) ..... 10 2004 002 423

(51) Int. Cl.
*G05F 1/10* (2006.01)

(52) U.S. Cl. ..... 327/538; 327/545; 327/546; 323/313

(58) Field of Classification Search ..... None
See application file for complete search history.

(56) References Cited

U.S. PATENT DOCUMENTS 5,604,427 A * 2/1997 Kimura ..... 323/313
5,828,329 A * 10/1998 Burns ..... 341/155
5,990,727 A * 11/1999 Kimura ..... 327/513
6,181,121 B1 * 1/2001 Kirkland et al. ..... 323/313
6,191,646 B1 * 2/2001 Shin ..... 327/543
6,366,071 B1 * 4/2002 Yu ..... 323/316
6,373,330 B1 * 4/2002 Holloway ..... 327/539
6,462,526 B1 10/2002 Tanase
2003/0001660 A1 * 1/2003 Yang ..... 327/540
2004/0066180 A1 * 4/2004 Harrison ..... 323/312
2004/0232976 A1 * 11/2004 Hwang et al. ..... 327/543

FOREIGN PATENT DOCUMENTS

EP 0 524 154 A2 1/1993
JP 02199516 A 8/1990

* cited by examiner

*Primary Examiner*—Tuan T Lam
(74) *Attorney, Agent, or Firm*—Maginot, Moore & Beck

(57) ABSTRACT

A bandgap reference circuit is proposed. To remove parasitic effects, this includes the combination of a first circuit section (1), which generates a temperature-proportional voltage, and a second circuit section (2), which generates an inversely temperature-proportional voltage. The bandgap reference circuit generates a bandgap reference voltage ($U_{bg}$) as the sum of the temperature-proportional voltage of the first circuit section (1) and the inversely temperature-proportional voltage of the second circuit section (2). To remove the parasitic effects, both circuit sections (1, 2) include bipolar transistor circuits with multiple bipolar transistors ($Q_1$-$Q_4$; $Q_5$-$Q_8$), so that both the temperature-proportional voltage and the inversely temperature-proportional voltage are generated in the form of a sum and difference formation of multiple base-emitter voltages of the appropriate bipolar transistors.

17 Claims, 3 Drawing Sheets

BANDGAP REFERENCE CIRCUIT

FIELD OF THE INVENTION

This invention concerns a bandgap reference circuit, which is used to provide a bandgap voltage, particularly in the form of a base-emitter voltage of a bipolar transistor, as a high-precision reference voltage.

BACKGROUND

Bandgap reference circuits traditionally have a bipolar transistor. A bandgap reference voltage is derived from the base-emitter voltage of the bipolar transistor and provided. However, at their base and emitter terminals bipolar transistors have parasitic resistances, which affect the base-emitter voltage on which the function of the bandgap reference circuit is based. This will be explained in more detail below on the basis of FIG. 4.

FIG. 4 shows a bipolar transistor with a parasitic base resistance $R_b$ and a parasitic emitter resistance $R_e$. The bipolar transistor is driven by a collector current $I_c$. The base-emitter voltage $U_{be}$ of the bipolar transistor shown in FIG. 4 is defined as follows:

$$U_{be} = U_t \ln\left(\frac{I_c}{I_s}\right) + I_c\left(1 + \frac{1}{\beta}\right)R_e + I_c\frac{1}{\beta}R_b \tag{1}$$

where $I_s$ is the reverse current of the bipolar transistor, and $\beta$ is the current amplification of the bipolar transistor. From Formula (1), the effect of the parasitic base and emitter resistances on the base-emitter voltage can be seen. These parasitic resistances result in the corresponding bandgap reference circuit being affected by parasitic temperature coefficients, which can only be controlled with difficulty and consequently result in imprecision and uncertainty in the circuit production.

Since all the voltages which are derived from the parasitic resistances are also referred to the collector current $I_c$, the effect of the parasitic resistances on the base-emitter voltage can be seen as derived from a virtual compensating resistance $R_{eq}$ at the emitter of the bipolar transistor, as is shown schematically in FIG. 5. For the base-emitter voltage $U_{be}$, the result, depending on the collector current $I_c$ and compensating resistance $R_{eq}$, is:

$$\begin{aligned} U_{be} &= U_t \ln\left(\frac{I_c}{I_s}\right) + I_c\left(\frac{\beta+1}{\beta}R_e + \frac{R_b}{\beta}\right) \\ &= U_t \ln\left(\frac{I_c}{I_s}\right) + I_c R_{eq} \end{aligned} \tag{2}$$

Consequently, to remove the effect of the parasitic resistances, the aim must be to compensate for the effect of the compensating resistance $R_{eq}$ (shown in FIG. 5) on the base-emitter voltage $U_{be}$. Traditionally, base-emitter interfaces are connected in series for this purpose.

For this purpose, in particular, constructing bandgap reference circuits in such a way that a temperature-proportional voltage, that is a voltage with a positive temperature coefficient, is added to a voltage which is inversely temperature-proportional and consequently has a negative temperature coefficient, in such a way that the resulting voltage has a negligible temperature coefficient, is known. The temperature-proportional voltage can be obtained as a voltage difference between two transistors which are operated with different current densities, whereas the voltage with the negative temperature coefficient is obtained as a voltage over a base-emitter interface.

The principle explained above will be described in more detail below with reference to FIG. 6, wherein in FIG. 6 a circuit arrangement called a Widlar bandgap reference circuit is shown.

The circuit arrangement shown in FIG. 6 consists essentially of a temperature-proportional first circuit section 1, which can also be called the PTAT ("proportional to absolute temperature") circuit section, and an inversely temperature-proportional second circuit section 2, which can be called the IPTAT ("inversely proportional to absolute temperature") circuit section. The first circuit section 1 includes two bipolar transistors $Q_1$ and $Q_2$, which are connected to each other as shown in FIG. 6. The bipolar transistors $Q_1$ and $Q_2$ are also connected to resistors $R_{bias}$, $R_{t1}$ and $R_{t2}$, as shown in FIG. 6. The first circuit section 1 generates a temperature-proportional current, which flows via the bipolar transistor $Q_2$ and resistor $R_{t2}$ and generates a voltage $U_{R12}$, which is proportional to the absolute temperature, there. The second circuit section 2 includes a bipolar transistor $Q_3$, the base-emitter voltage $U_{beQ3}$ of which is inversely proportional to the absolute temperature. The output of the bandgap reference circuit is connected to the two circuit sections 1, 2 in such a way that the bandgap reference voltage $U_{bg}$ which can be tapped there is defined by the sum of the voltages $U_{R12}$ and $U_{beQ3}$.

Irrespective of the fact that using the bandgap reference circuit shown in FIG. 6, a bandgap reference voltage with a mostly negligible temperature coefficient can be generated, the parasitic resistances which were explained above on the basis of FIGS. 4 and 5 are still included in the circuit, and because of their temperature coefficients they affect the base-emitter voltages of the relevant bipolar transistors and consequently the bandgap reference voltage of the entire circuit.

SUMMARY

This invention is therefore based on the object of providing a bandgap reference circuit in which there is compensation for the effect of parasitic resistances, so that a high-precision bandgap reference voltage can be generated.

According to the invention, this object is achieved by a bandgap reference circuit according to preferred and advantageous embodiments of this invention.

According to embodiments of the invention, it is proposed that with a first circuit section a temperature-proportional voltage should be generated, and with a second circuit section an inversely temperature-proportional voltage should be generated, in such a way that as the combination, particularly the sum, of both voltages, the desired bandgap reference voltage can be tapped via an output terminal. To remove the effect of parasitic resistances in both circuit sections, the appropriate voltage is generated as a combination of multiple base-emitter voltages of corresponding bipolar transistors of an appropriate bipolar transistor circuit.

The temperature-proportional first circuit section preferably includes four bipolar transistors, which are connected to each other in such a way that at a resistor which is connected to the emitter of one of the bipolar transistors a voltage proportional to the absolute temperature is generated. This voltage consists of the sum of two base-emitter voltages of two of the four bipolar transistors, from which in turn the base-emitter voltages of the other two bipolar transistors are subtracted. This temperature-proportional voltage is directly related to a corresponding temperature-proportional current, which corresponds to the collector current of the bipolar transistor connected to the above-mentioned resistor, and is preferably fed to the inversely temperature-proportional second circuit section.

By specially choosing the currents which flow via the individual bipolar transistors and the effective transistor areas of the individual bipolar transistors of the first circuit section, it is possible to achieve that the effect of the parasitic resistances is completely removed.

The inversely temperature-proportional second circuit section preferably also includes multiple bipolar transistors, which are connected to each other in such a way that as the inversely temperature-proportional voltage, a base-emitter voltage consisting of the sum of the base-emitter voltages of two of the bipolar transistors, from which the base-emitter voltage of another bipolar transistor is subtracted, can be obtained. If the effective transistor area of these three bipolar transistors is chosen to conform to a specified ratio, compensation for the effect of the parasitic resistance can also be achieved for the second circuit section.

BRIEF DESCRIPTION OF THE DRAWINGS

The invention is explained in more detail below, with reference to the attached drawings and on the basis of a preferred embodiment.

DETAILED DESCRIPTION

Figure 1:
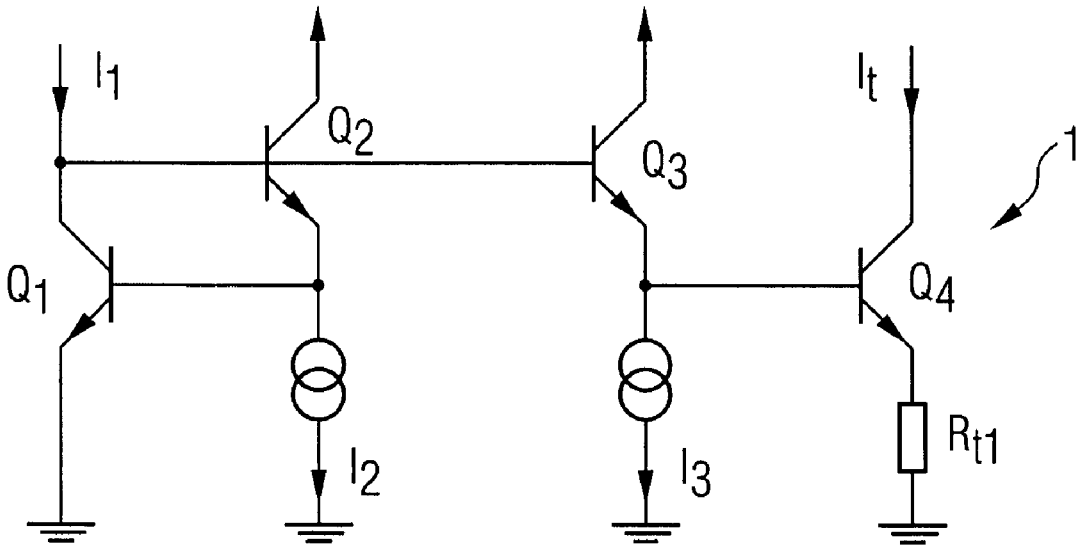
FIG. 1 shows a simplified circuit diagram of a PTAT circuit section of a bandgap reference circuit according to a preferred embodiment of this invention.

In FIG. 1, a circuit diagram of a PTAT circuit section 1 of a bandgap reference circuit according to the invention is shown. This circuit section generates a temperature-proportional voltage and a corresponding temperature-proportional current $I_t$.

For this purpose, the circuit section 1 includes four bipolar transistors $Q_1$-$Q_4$, which are connected to each other as shown in FIG. 1. The bipolar transistor $Q_1$, with its collector-emitter link, is connected between a positive supply voltage potential and earth. The collector of the bipolar transistor $Q_1$ is connected to the base of the bipolar transistor $Q_2$. The current which is fed to the connecting point between the collector of the bipolar transistor $Q_1$ and the base of the bipolar transistor $Q_2$ is designated $I_1$. The emitter of the bipolar transistor $Q_2$ is connected to the base of the bipolar transistor $Q_1$. The base of the bipolar transistor $Q_3$ is also connected to the collector of the bipolar transistor $Q_1$, and the emitter of the bipolar transistor $Q_3$ is connected to the base of the bipolar transistor $Q_4$. The bipolar transistor $Q_4$, with its collector-emitter link, similarly to the bipolar transistor $Q_1$, is connected between the positive supply voltage potential and earth. Between the earth potential and the emitter of the bipolar transistor $Q_4$, a resistor $R_{t1}$ is arranged. The above-mentioned temperature-proportional current $I_t$ corresponds to the collector current of the bipolar transistor $Q_4$.

In FIG. 1, for clarity, the individual parasitic resistances are not shown.

Ideally, the voltage which drops out at the resistor $R_{t1}$ should be temperature-proportional. If it is assumed that a bipolar transistor of area n can be understood as n individual transistors, the voltage $U_{Rt1}$ which drops out at the resistor $R_{t1}$ can be calculated as follows:

$$\begin{aligned} U_{Rt1} &= U_{be1} + U_{be2} - U_{be3} - U_{be4} \\ &= U_t \ln\left(\frac{I_1}{I_{s1}}\right) + R_{eq1} I_1 + U_t \ln\left(\frac{I_2}{I_{s2}}\right) + R_{eq2} I_2 - \\ &\quad U_t \ln\left(\frac{I_3}{I_{s3}}\right) - R_{eq3} I_3 - U_t \ln\left(\frac{I_t}{I_{s4}}\right) - R_{eq4} I_t \\ &= U_t \ln\left(\frac{I_1 I_2}{I_3 I_t}\frac{A_3 A_4}{A_1 A_2}\right) + R_{eq}\left(\frac{I_1}{A_1} + \frac{I_2}{A_2} - \frac{I_3}{A_3} - \frac{I_t}{A_4}\right) \\ &\quad \left(R_{eqn} = \frac{R_{eq}}{A_n}\right) \end{aligned} \tag{3}$$

Figure 5:
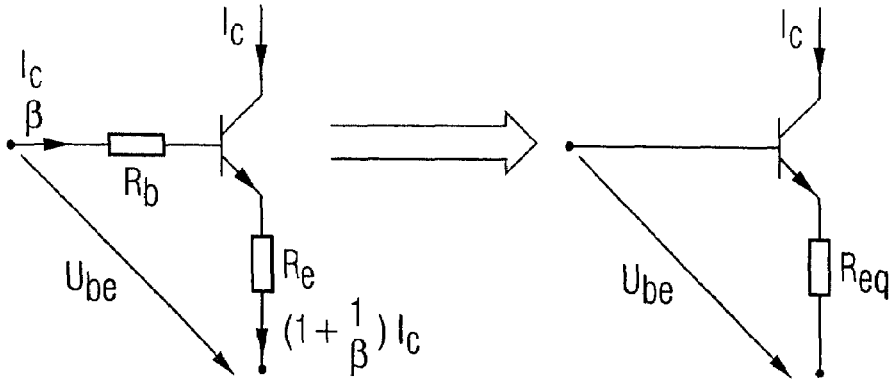
FIG 5 PRIOR ART
FIG. 5 shows a replacement circuit diagram for the bipolar transistor shown in FIG. 4, with an equivalent parasitic emitter resistance.

$U_{bei}$ designates the base-emitter voltage of the bipolar transistor $Q_i$, where i=1 . . . 4, and $I_{si}$ designates the reverse current of the bipolar transistor $Q_i$. $U_t$ designates the thermoelectric voltage, and $R_{eqi}$ designates the compensating resistance, at the emitter of the bipolar transistor $Q_i$ according to the circuit diagram shown in FIG. 5. Finally, $A_i$ designates the transistor area of the bipolar transistor $Q_i$. $R_{eq}$ is the equivalent parasitic resistance of a unit transistor.

To generate an exclusively temperature-proportional voltage $U_{Rt1}$, according to Formula (3) the following two conditions must be fulfilled:

$$\frac{I_1 I_2}{I_3 I_t}\frac{A_3 A_4}{A_1 A_2} \neq 1 \quad \text{and} \quad \frac{I_1}{A_1} + \frac{I_2}{A_2} = \frac{I_3}{A_3} + \frac{I_t}{A_4} \tag{4}$$

In the preferred application case, the currents $I_1$, $I_2$, $I_3$ correspond to the temperature-proportional output current $I_t$, which can be implemented by using appropriate current mirrors (not shown in FIG. 1 for simplicity). In this special application case, for instance, $A_1$=4, $A_2$=6, $A_3$=12 and $A_4$=3 can be chosen, obviously without the transistor areas being restricted to this particular embodiment.

Figure 2:
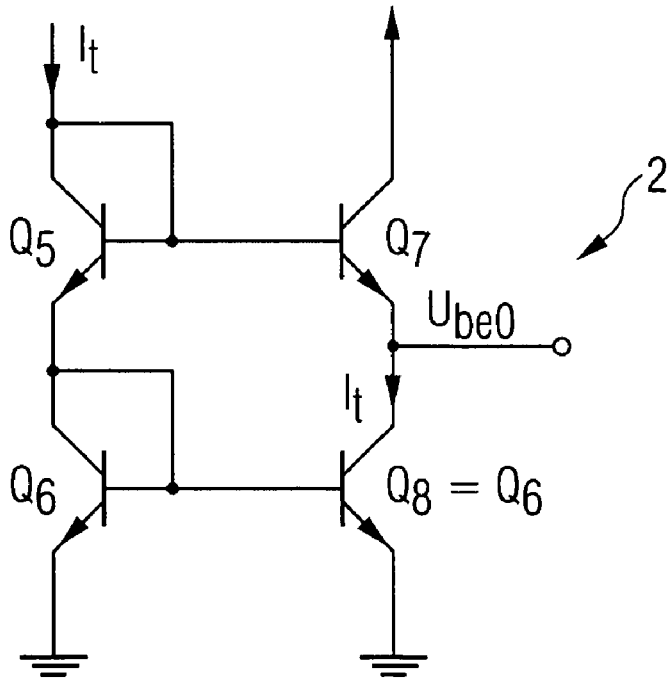
FIG. 2 shows a simplified circuit diagram of an IPTAT circuit section of the bandgap reference circuit according to the invention.

In FIG. 2, an IPTAT circuit section 2 of the bandgap reference circuit according to the invention is shown.

Figure 6:
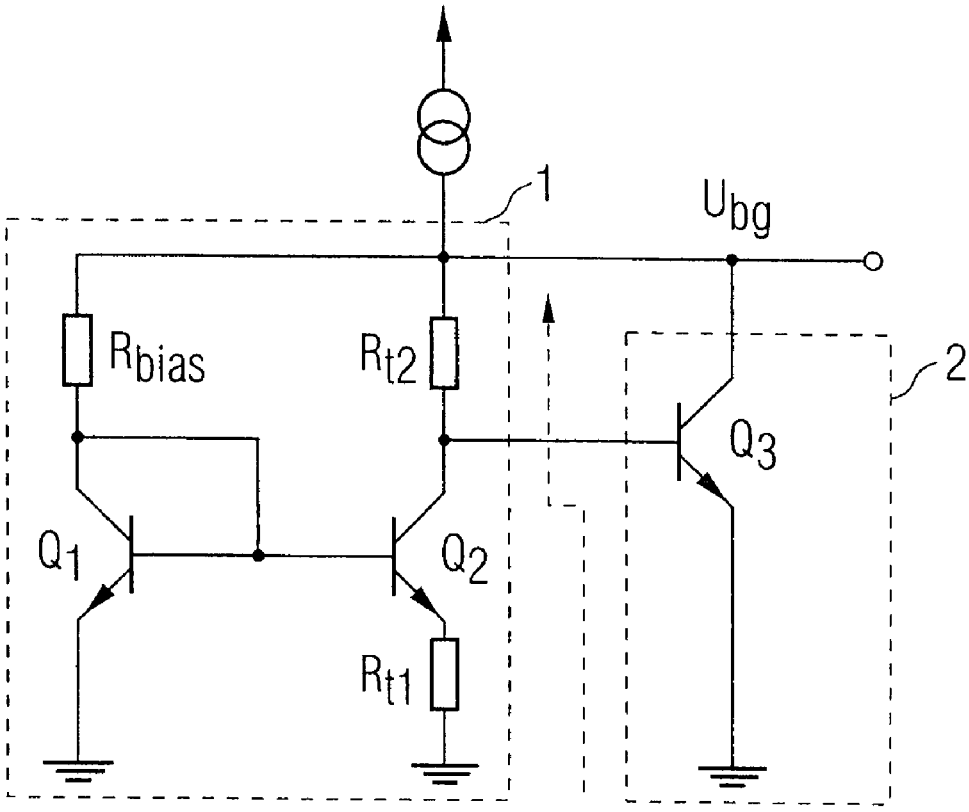
FIG 6 PRIOR ART
FIG. 6 shows a Widlar bandgap reference circuit according to the prior art.

In contrast to the traditional Widlar bandgap reference circuit shown in FIG. 6, in which the IPTAT circuit section includes only one bipolar transistor, according to FIG. 2 four bipolar transistors $Q_5$-$Q_8$, connected to each other, are provided. Whereas in the prior art the base-emitter voltage, which is inversely proportional to temperature, of the only bipolar transistor is relatively strongly affected by the parasitic resistances of the bipolar transistor, by using the circuit arrangement shown in FIG. 2 a base-emitter voltage can be obtained as an inversely temperature-proportional voltage $U_{be0}$, which is not affected by parasitic base or emitter resistances. According to FIG. 2, this is achieved by two base-emitter voltages first being added and a base-emitter voltage being subtracted from the sum, so that by suitable transistor scaling compensation of all parasitic effects can be achieved.

As can be seen in FIG. 2, the temperature-proportional current $I_t$ which is generated from the PTAT circuit section 1 is used as the operating current for the bipolar transistors $Q_5$ and $Q_6$, which are connected as diodes (the collector and base of the bipolar transistors $Q_5$ and $Q_6$ are each short-circuited). It is also assumed that the two bipolar transistors $Q_6$ and $Q_8$ are identically dimensioned.

The base of the bipolar transistor $Q_5$ is connected to the base of the bipolar transistor $Q_7$, whereas the base of the bipolar transistor $Q_6$ is connected to the base of the bipolar transistor $Q_8$. Additionally, the emitter of the bipolar transistor $Q_5$ is connected to the collector of the bipolar transistor $Q_6$, whereas the emitter of the bipolar transistor $Q_7$ is connected to the collector of the bipolar transistor $Q_8$. The emitter terminals of the bipolar transistors $Q_6$ and $Q_8$ are each connected to earth potential. Between the emitter of the bipolar transistor $Q_7$ and the collector of the bipolar transistor $Q_8$, there is an output terminal.

The output voltage of the circuit section shown in FIG. 2 is defined as follows (the bipolar transistor $Q_7$ gives $U_{be}$, whereas the bipolar transistor $Q_8$ gives the current through the bipolar transistor $Q_7$):

$$\begin{aligned} U_{be0} &= U_{be5} + U_{be6} - U_{be7} \\ &= U_t \ln\left(\frac{I_t}{I_{s5}}\right) + R_{eq5} I_t + U_t \ln\left(\frac{I_t}{I_{s6}}\right) + R_{eq6} I_t - \\ &\quad U_t \ln\left(\frac{I_t}{I_{s7}}\right) - R_{eq7} I_t \\ &= U_t \ln\left(I_t \frac{I_{s7}}{I_{s5} I_{s6}}\right) + R_{eq} I_t \left(\frac{1}{A_5} + \frac{1}{A_6} - \frac{1}{A_7}\right) \end{aligned} \tag{5}$$

Regarding the values which are included in Formula (5), refer to the explanations about Formula (3).

To compensate for the parasitic part of $U_{be0}$, the following condition must be fulfilled:

$$\frac{1}{A_5} + \frac{1}{A_6} = \frac{1}{A_7} \tag{6}$$

Figure 3:
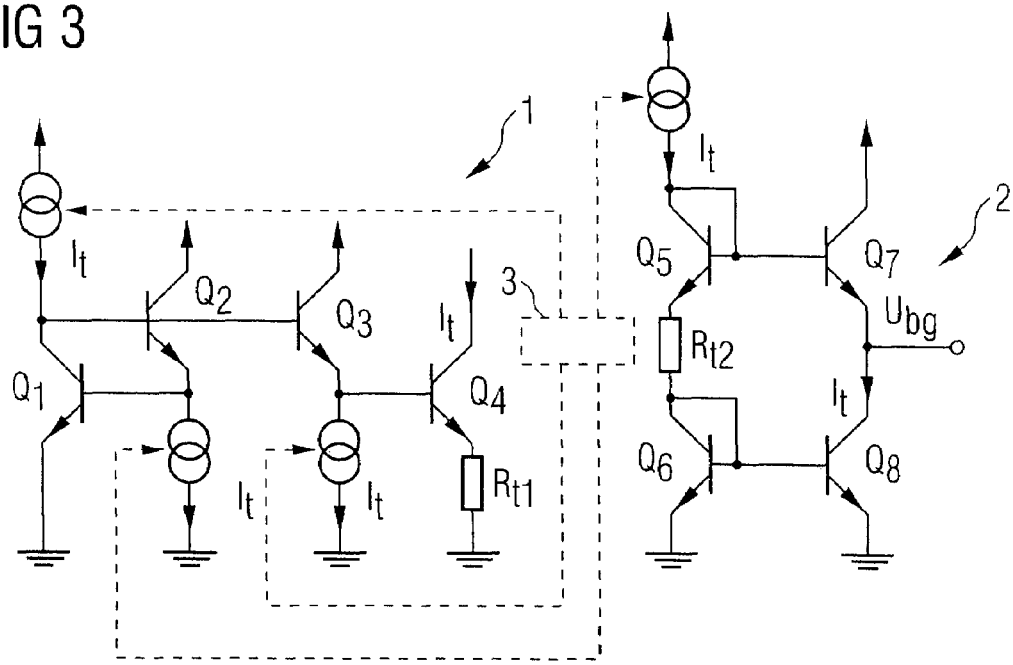
FIG. 3 shows the complete bandgap reference circuit consisting of the circuit sections shown in FIGS. 1 and 2.
Figure 4:
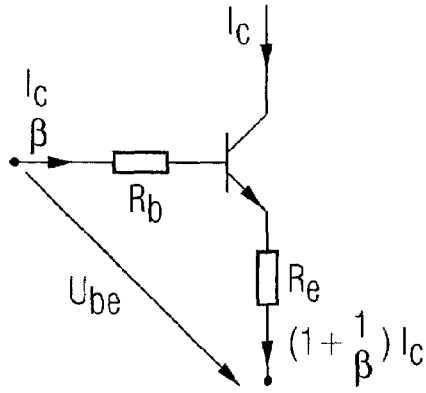
FIG 4 PRIOR ART
FIG. 4 shows a bipolar transistor with parasitic base and emitter resistances.

In FIG. 3, the bandgap reference circuit consisting of the two circuit sections 1, 2 is shown as a whole. Additionally to FIG. 2, between the emitter of the bipolar transistor $Q_5$ and the collector of the bipolar transistor $Q_6$, a resistor $R_{t2}$ is inserted, so that at the resistor $R_{t2}$, because of the temperature-proportional current $I_t$, a temperature-proportional voltage $U_{Rt2}$ drops out. Thus, for the bandgap reference voltage $U_{bg}$ which can be tapped between the emitter of the bipolar transistor $Q_7$ and the collector of the bipolar transistor $Q_8$, the following applies:

$$U_{bg} = U_{be0} + U_{Rt2} \tag{7}$$

From Formula (7), it can be seen that the bandgap reference voltage $U_{bg}$ consists of the sum of the inversely temperature-proportional voltage $U_{be0}$ and the temperature-proportional voltage $U_{Rt2}$, but because of the special construction of the two circuit sections 1, 2, there is compensation for the effects of parasitic resistances of the bipolar transistors which are used. Thus in total, a bandgap reference voltage without a temperature coefficient, or with only a negligible temperature coefficient, is provided, and additionally effects of parasitic resistances are removed.

From FIG. 3, it can be seen that the temperature-proportional current $I_t$ which is generated by the PTAT circuit section 1 is used to operate the whole bandgap reference circuit. In FIG. 3, the current mirrors which are used to impress the current $I_t$ onto the bipolar transistors $Q_1$-$Q_3$ and the bipolar transistors $Q_5$-$Q_6$ are indicated in the form of an appropriate current balancing circuit 3 in combination with appropriate current sources.

Since the PTAT circuit section 1 is itself biased with the current $I_t$, care should be taken that operation of the PTAT circuit section 1 is started correctly, which can be done simply by using a startup circuit.

The invention claimed is:

1. A bandgap reference circuit, comprising:

a first circuit section having a first plurality of bipolar transistors configured to generate a temperature-proportional voltage, the temperature-proportional voltage generated as a combination of multiple base-emitter voltages of at least some of the first plurality of bipolar transistors;

a second circuit section having a second plurality of bipolar transistors configured to generate an inversely temperature-proportional voltage, the inversely temperature-proportional voltage generated as a combination of multiple base-emitter voltages of at least some of the second plurality of bipolar transistors; and wherein the first circuit section and the second circuit section are connected to each other in such a way that, at an output terminal of the bandgap reference circuit, a bandgap reference voltage is tapped as a combination of the temperature-proportional voltage of the first circuit section and the inversely temperature-proportional voltage of the second circuit section;

wherein the first circuit section includes four bipolar transistors connected such that the temperature-proportional voltage is generated as the sum of the base-emitter voltages of first and second of the four bipolar transistors minus the base-emitter voltages of third and fourth of the four bipolar transistors;

a collector of the first bipolar transistor of the first circuit section is connected to a base of the second bipolar transistor and a base of the third bipolar transistor of the first circuit section;

an emitter of the second bipolar transistor of the first circuit section is connected to a base of the first bipolar transistor of the first circuit section;

an emitter of the third bipolar transistor of the first circuit section is connected to a base of the fourth bipolar transistor of the first circuit section; and the temperature-proportional voltage is provided at an emitter of the fourth bipolar transistor of the first circuit section.

2. The bandgap reference circuit according to claim 1, wherein the first circuit section and the second circuit section are connected to each other in such a way that, at the output terminal of the bandgap reference circuit, the bandgap reference voltage is tapped as the sum of the temperature-proportional voltage of the first circuit section and the inversely temperature-proportional voltage of the second circuit section.

3. The bandgap reference circuit according to claim 1, wherein the four bipolar transistors of the first circuit section are configured to generate the temperature-proportional voltage proportionally to the expression $$U_t \ln\left(\frac{I_1 I_2}{I_3 I_t}\frac{A_3 A_4}{A_1 A_2}\right),$$

where $I_1$ designates a current which is provided to a connecting point between the collector of the first bipolar transistor and the base of the second bipolar transistor, $I_2$ designates a current which is derived from a connecting point between the base of the first bipolar transistor and the emitter of the second bipolar transistor, $I_3$ designates a current which is derived from a connecting point between the emitter of the third bipolar transistor and the base of the fourth bipolar transistor, $I_t$ designates a current which is fed to a collector of the fourth bipolar transistor, and $U_t$ designates the thermoelectric voltage, and where $A_1$, $A_2$, $A_3$ and $A_4$ designate a transistor area of the first, second, third and fourth bipolar transistor respectively of the first circuit section.

4. The bandgap reference circuit according to claim 3, wherein the currents $I_1$, $I_2$, $I_3$, $I_t$ and the transistor areas $A_1$, $A_2$, $A_3$, $A_4$ are chosen so that the following is true:

$$\frac{I_1}{A_1} + \frac{I_2}{A_2} = \frac{I_3}{A_3} + \frac{I_t}{A_4}.$$

5. The bandgap reference circuit according to claim 3, wherein the first circuit section is in such a form that the currents $I_1$, $I_2$, $I_3$ and $I_t$ are substantially the same.

6. The bandgap reference circuit according to claim 3, wherein the first circuit section includes current mirrors, so that each of the currents $I_1$, $I_2$, $I_3$ is generated as a current which is generated from the current $I_t$ by the current mirrors.

7. A bandgap reference circuit, comprising:

a first circuit section having a first plurality of bipolar transistors configured to generate a temperature-proportional voltage, the temperature-proportional voltage generated as a combination of multiple base-emitter voltages of at least some of the first plurality of bipolar transistors;

a second circuit section having a second plurality of bipolar transistors configured to generate an inversely temperature-proportional voltage, the inversely temperature-proportional voltage generated as a combination of multiple base-emitter voltages of at least some of the second plurality of bipolar transistors; and wherein the first circuit section and the second circuit section are connected to each other in such a way that, at an output terminal of the bandgap reference circuit, a bandgap reference voltage is tapped as a combination of the temperature-proportional voltage of the first circuit section and the inversely temperature-proportional voltage of the second circuit section, wherein the second circuit section includes three bipolar transistors configured such that the inversely temperature-proportional voltage is generated as the sum of base-emitter voltages of first and second of the three bipolar transistors minus a base-emitter voltage of a third of the three bipolar transistors.

8. The bandgap reference circuit according to claim 7, wherein:

the second circuit section includes a first bipolar transistor, a second bipolar transistor and a third bipolar transistor;

an emitter of the first bipolar transistor of the second circuit section is connected to a collector of the second bipolar transistor of the second circuit section, a collector and base of the first bipolar transistor and the collector and a base of the second bipolar transistor of the second circuit section are connected to each other, the base of the first bipolar transistor of the second circuit section being connected to a base of the third bipolar transistor of the second circuit section, and the inversely temperature-proportional voltage of the second circuit section is generated at an emitter of the third bipolar transistor of the second circuit section.

9. Bandgap reference circuit according to claim 8, wherein the second circuit section includes a fourth bipolar transistor, the base of which is connected to the base of the second bipolar transistor of the second circuit section, and the collector of which is connected to the emitter of the third bipolar transistor of the second circuit section.

10. Bandgap reference circuit according to claim 9, wherein the second bipolar transistor of the second circuit section and the fourth bipolar transistor of the second circuit section have the same design.

11. Bandgap reference circuit according to claim 8, wherein the bipolar transistors of the second circuit section are connected to each other in such a way that the inversely temperature-proportional voltage is generated according to the expression $$U_t \ln\left(I_t \frac{I_{s7}}{I_{s5} I_{s6}}\right),$$

where $I_t$ designates a current which is fed to a connecting point between the collector and the base of the first bipolar transistor of the second circuit section, $I_{s5}$ designates a reverse current of the first bipolar transistor of the second circuit section, $I_{s6}$ designates a reverse current of the second bipolar transistor of the second circuit section, $I_{s7}$ designates a reverse current of the third bipolar transistor of the second circuit section, and $U_t$ designates the thermoelectric voltage.

12. Bandgap reference circuit according to claim 8, wherein the first bipolar transistor, the second bipolar transistor and the third bipolar transistor of the second circuit section have transistor areas according to the relationship $$\frac{1}{A_5} + \frac{1}{A_6} = \frac{1}{A_7},$$

where $A_5$ designates the transistor area of the first bipolar transistor of the second circuit section, $A_6$ designates the transistor area of the second bipolar transistor of the second circuit section, and $A_7$ designates the transistor area of the third bipolar transistor of the second circuit section.

13. Bandgap reference circuit according to claim 8, wherein the first circuit section is designed such that, depending on the temperature-proportional voltage, it generates a temperature-proportional current, and wherein current mirrors are provided between the first circuit section and the second circuit section in such a way that a current is fed to a connecting point between the collector and the base of the first bipolar transistor of the second circuit section, corresponding to the temperature-proportional current of the first circuit section, which is replicated by the current mirrors.

14. A bandgap reference circuit, comprising:

a first circuit section having at least four bipolar transistors configured to generate a temperature-proportional voltage, the temperature-proportional voltage generated as a combination of multiple base-emitter voltages of at least some of the at least four bipolar transistors;

a second circuit section having at least three bipolar transistors configured to generate an inversely temperature-proportional voltage, the inversely temperature-proportional voltage generated as a combination of multiple base-emitter voltages of at least some of the at least three bipolar transistors; and wherein the first circuit section and the second circuit section are connected to each other in such a way that, at an output terminal of the bandgap reference circuit, a bandgap reference voltage is tapped as a combination of the temperature-proportional voltage of the first circuit section and the inversely temperature-proportional voltage of the second circuit section;

wherein the temperature-proportional voltage is generated as the sum of the base-emitter voltages of first and second of the four bipolar transistors minus the base-emitter voltages of third and fourth of the four bipolar transistors a collector of the first bipolar transistor of the first circuit section is connected to a base of the second bipolar transistor and a base of the third bipolar transistor of the first circuit section;

an emitter of the second bipolar transistor of the first circuit section is connected to a base of the first bipolar transistor of the first circuit section;

an emitter of the third bipolar transistor of the first circuit section is connected to a base of the fourth bipolar transistor of the first circuit section; and the temperature-proportional voltage is provided at an emitter of the fourth bipolar transistor of the first circuit section.

15. The bandgap reference circuit according to claim 14, wherein the second circuit section includes three bipolar transistors configured such that the inversely temperature-proportional voltage is generated as the sum of base-emitter voltages of first and second of the three bipolar transistors minus a base-emitter voltage of a third of the three bipolar transistors.

16. The bandgap reference circuit according to claim 15, wherein:

the second circuit section includes a first bipolar transistor, a second bipolar transistor and a third bipolar transistor;

an emitter of the first bipolar transistor of the second circuit section is connected to a collector of the second bipolar transistor of the second circuit section, a collector and base of the first bipolar transistor and the collector and a base of the second bipolar transistor of the second circuit section are connected to each other, the base of the first bipolar transistor of the second circuit section being connected to a base of the third bipolar transistor of the second circuit section, and the inversely temperature-proportional voltage of the second circuit section is generated at an emitter of the third bipolar transistor of the second circuit section.

17. The bandgap reference circuit according to claim 16, wherein the second circuit section includes a fourth bipolar transistor having a base connected to the base of the second bipolar transistor of the second circuit section, the fourth bipolar transistor further including a collector connected to the emitter of the third bipolar transistor of the second circuit section.

* * * * *